US006500787B1

(12) United States Patent
Tanaka et al.

(10) Patent No.: US 6,500,787 B1
(45) Date of Patent: Dec. 31, 2002

(54) LUBRICANT COMPOSITION AND ITS USE IN A BALL JOINT

(75) Inventors: Keiji Tanaka, Tokyo (JP); Yoshihisa Yatsuzuka, Tokyo (JP); Ryuichi Masumori, Tokyo (JP)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/913,136

(22) PCT Filed: Feb. 9, 2000

(86) PCT No.: PCT/EP00/01106

§ 371 (c)(1),
(2), (4) Date: Aug. 9, 2001

(87) PCT Pub. No.: WO00/47699

PCT Pub. Date: Aug. 17, 2000

(30) Foreign Application Priority Data

Feb. 12, 1999 (JP) ..... 11-034963

(51) Int. Cl.[7] ..... C10M 169/00; C10M 169/02

(52) U.S. Cl. ..... 508/451; 508/551; 508/591

(58) Field of Search ..... 508/450, 451

(56) References Cited

U.S. PATENT DOCUMENTS

| | | | | | |
|---|---|---|---|---|---|
| 4,371,446 | A | * | 2/1983 | Kinoshita et al. | 508/551 |
| 4,956,122 | A | * | 9/1990 | Watts et al. | 585/11 |
| 5,110,489 | A | * | 5/1992 | Stadler et al. | 508/591 |
| 5,681,797 | A | * | 10/1997 | Lawate | 508/280 |
| 5,939,367 | A | * | 8/1999 | Cuse | 508/591 |
| 6,162,772 | A | * | 12/2000 | Dounis | 508/583 |

* cited by examiner

*Primary Examiner*—Ellen M. McAvoy

(57) ABSTRACT

A lubricant composition and a ball joint are disclosed. The lubricant composition has about 100 parts by weight of a viscous material chosen from polyisoprene rubber or a viscous composition of a polyisoprene rubber viscous substance, about 15–45 parts by weight of at least one compound chosen from a specific group of aliphatic amides or a specific group of aliphatic bisamides and about 5–30 parts by weight of at least one wax chosen from polyethylene wax, paraffin wax and microcrystalline wax. A ball joint is disclosed that contains this lubricant composition.

15 Claims, 3 Drawing Sheets

LUBRICANT COMPOSITION AND ITS USE IN A BALL JOINT

FIELD OF THE INVENTOIN

This invention relates to lubricant compositions. The invention is especially concerned with a ball joint comprising a ball seat of synthetic resin and a metal ball stat which ball joint further comprises lubricant composition according to the present invention, and use of a lubricant composition in such ball joint.

BACKGROUND OF THE INVENTION

In ball joints commonly used in automobiles, the basic method of lubrication is the presence of lubricant between the ball seat 1 of synthetic resin and the metal ball stat 2. Several methods have been proposed for the maintenance and improvement of the performance of ball joints. For example, the hardness was increased in the ball stat to prevent abrasion; molybdenum, graphite or lubricating oil were incorporated in the ball seat so as to increase the gliding property of the resin itself, or a groove was incorporated on the inner surface of the ball seat to act as a reservoir of grease.

However, there is a limit in improvement of the performance of ball joints by these methods. At present, the major opportunity for improvement of performance of ball joints is thought to reside in a lubricant having improved properties.

Ball joints are placed at the extremely important positions in the suspension system and the steering system concerned with the movement of motor vehicles. Direct influence is exerted by the joint on the movement. Therefore, there is a severe problem if the position of the ball stat is altered greatly under load.

In the process of assembling a ball stat, a ball seat and a socket, some load is applied to the ball seat through the ball stat so that the clearance is made as small as possible between the ball stat and the ball seat by taking advantage of iscoelasticity of a synthetic resin. Also it is attempted to limit as much as possible the displacement of the ball stat under a load. Consequently, a certain pressure is maintained in the space between the ball stat and the ball seat, and ordinary lubricating grease tends to be extruded from the space between the ball stat and the ball seat with elapse of time. As the result, the torque upon movement becomes greater and the lubricant membrane is broken during repeated movement, resulting in direct contact between the ball stat and the ball seat, the development of abrasion and an increased displacement of the ball stat.

A lubricant composition to be used in ball joints preferably has the following characteristics: under a load, the lubricant composition preferably adheres strongly to both the ball stat and ball seat to form a membrane with a constant thickness. The lubricant composition preferably flows smoothly at the gliding part when the ball stat moves from the stationary condition to the moving condition, and the grease membrane is preferably maintained without change even after repeated movement of the ball stat so that a stable lubricating function is maintained.

Patent cases concerned with ball joints, are the follows.

Japanese Kokai Patent Application No. Sho 60 [1996]-31598 describes a grease product containing poly-α-olefin type synthetic oil with kinematic viscosity of 500–2000 $mm^2$/sec at 40° C., paraffin wax, fatty acid amide wax and urea type thickening agent.

Japanese Kokai Patent Application No. Hei 2[1990]-194095 describes a grease product for ball joints containing urea type thickening agent, hydrogenated mineral oil devoid of wax with the kinematic viscosity of 50–500 $mm^2$/sec at 40° C., paraffin wax and fatty acid amide wax.

Japanese Kokai Patent Application No. Hei 6[1994]-116581 describes a lubricating product for ball joints characterized by a content of polyisoprene rubber or polyisoprene rubber viscous material with the viscosity of $3\times10^3$–$10^5$ mN.s/m2 (cP) at 25° C. and aliphatic amide or aliphatic bisamide.

The present invention relates to a further improvement of the technology made public by our Kokai Patent Application No. Hei 6[1994]-116581.

SUMMARY OF THE INVENTION

This invention relates to a lubricant composition comprising (A) 100 parts by weight of a viscous material having a viscosity from $3\times10^3$ to $10^5$ mN.s/$m^2$ (cP) at 25° C. which is at least one member chosen from the group consisting of (i) polyisoprene rubber and (ii) viscous composition containing polyisoprene rubber (B) 15–45 parts by weight of at least one compound from the group of aliphatic amides represented by Formula (1)

$$R^1CONH_2 \quad (1)$$

(where $R^1$ indicates a saturated or unsaturated alkyl group containing 15–17 carbon atoms), and aliphatic bisamides represented by Formula (2)

$$R^1CONHR^2NHCOR^1 \quad (2)$$

(wherein $R^1$ represents a saturated or unsaturated alkyl group and $R^2$ represents methylene or ethylene), and (C) 5–30 parts by weight of at least one wax chosen from the group of polyethylene wax, paraffin wax and microcrystalline wax.

Lubricant composition according to the present invention was found to give a low torque especially at working conditions (rotatory torque), more especially at working conditions at normal temperature, and to inhibit torque change and to give a ball joint giving good endurance.

Further, the composition was found to inhibit variation in the ball stat after repeated use. A good abrasion resistance was found in durability tests.

Further, the present invention relates to a ball joint comprising a ball seat (1) of synthetic resin and a metal ball stat (2), which ball joint comprises a lubricant composition according to the present invention, and to use of the lubricant composition in such ball joint.

DETAILED DESCRIPTION OF THE INVENTION

Component (A) used as the viscosity agent in this invention has a relation with adhesiveness on the sliding surfaces of ball joints and smooth working property, and its viscosity must be in the range from $3\times10^3$ to $10^5$ mN.s/$M^2$ (cP) at 25° C. If the viscosity is less than $3\times10^3$ mN.s/$m^2$ (cP), the lubricating product has poor adhesive property and the gliding membrane tends to become thin so that the resin and the metal make direct contact at the boundary plane resulting in the increased torque. On the other hand, if the viscosity is greater than $10^5$ mN.s/$m^2$ (cP), the resistance is increased in the lubricating oil itself, resulting in the increased torque of the ball joint.

The aforementioned polyisoprene rubber has the repeating unit

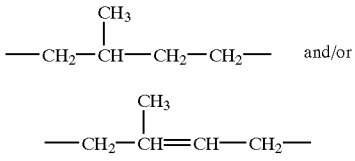

(3) and/or (4)

The polyisoprene rubber will generally contain a block of (3) and/or (4) mentioned above. Polymer additives, such as polybutene, polyisobutylene, and polymethacrylate could not achieve the aim of this invention, unlike polyisoprene.

Viscous composition containing polyisoprene rubber can be obtained by addition of mineral oil and/or synthetic oil to polyisoprene rubber. There is no particular limit in the ratio of mixing, and a mixture can be accepted if the viscosity is in the range from $3\times10^3$ to $10^5$ mN.s/m$^2$ (cP).

Synthetic oil is defined as publicly known oil used as the base oil for production of usual lubricating oil or grease, for example paraffin type mineral oil or naphthene type mineral oil such as the mineral type or poly-α-olefin, cooligomer of α-olefin and ethylene, polyethylene glycol and polypropylene glycol as alklene glycol type; alkyldiphenylether as ether type; and dimethylsilicone as silicone type.

The amide used as component (B) has the function of turning the viscous component (A) into a solid or semisolid and the function of reducing the friction coefficient between the resin and the metal as well as improving the inner fluidity of viscous substance. If the content of this component is less than 15 parts by weight, the lubricant becomes too soft and tends to flow easily so that the effect is weakened for improved gliding property between the resin and the metal. On the other hand, if its content is more than 45 parts by weight, the lubricant becomes too hard and difficult to handle, and the lubricating property is also reduced. Also, there is a possibility that it is too difficult to fill the space between the ball stat and the ball seat under pressure.

The polyethylene wax, paraffin wax and/or microcrystalline wax used as component(C), has the function of reducing the flow resistance in the lubricant formed by component (A) and component (B) and hence reducing the increase of torque of the ball joint resulting from the viscous resistance. If its content is less than 5 parts by weight, the effect is too small for reduction of flow resistance and the lowering effect cannot be expected on the ball joint torque. On the other hand, if the content is more than 30 parts by weight, the lubricant becomes too hard and difficult to handle. Also the expected effect may not be achieved, and it may not be possible to introduce the lubricant under pressure in the filling operation of the joint. The aforementioned polyethylene wax is a substance obtained as the by-product in the process of polyethylene production. It is a synthetic wax such as product of thermal decomposition of polyethylene or product of direct polymerization of ethylene. It is preferable to use polyethylene wax with an average molecular weight of 900–4,000 and a melting point of 100–130° C. Paraffin wax and microcrystalline wax are petroleum waxes classified as natural wax. In the process of distillation of crude oil under reduced pressure, paraffin wax is obtained from the distillate by separation and purification. It is a saturated hydrocarbon compound with the main component of straight chain hydrocarbons with an average molecular weight of 300–500. Wax with the melting point of 40–70° C. is preferable. Microcrystalline wax is obtained from the residual oil after the distillation of crude oil under pressure. It consists of saturated hydrocarbon compounds in microcrystal form with the average molecular weight of 500–700 with the main component of hydrocarbon with side chain or hydrocarbon in ring form. Wax with a melting point of 60–100° C. is preferable.

It is possible to add an antioxidant, rust-proofing agent, agent for improvement of oil properties, solid lubricant, antiabrasion agent and extreme pressure agent to the lubricant composition of this invention, if necessary.

With the lubricant product of this invention for ball joints, the following tests preferably have results detailed below: the amount of lift after endurance test ($10^6$ times) is preferably 0.1 mm or less, or more preferably 0.08 mm or less, most preferably 0.05 mm or less. The "lift" has been defined in the examples. The starting torque at −20° C. is preferably 50.0 kg·cm or less, and the rotating torque at −20° C. is preferably 30.0 kg·cm or less. The starting torque at 25° C. is preferably 30.0 kg·cm or less, and the rotating torque at 25° C. is preferably 13.0 kg·cm or less.

The worked penetration according to ASTM D 217 is preferably such that it is in the range from 220 to 340 0.1 mm at 25° C., especially 260 to 320 for the lubrication product of this invention for ball joints. If the worked penetration is less than 220, the composition might become too hard and the handling of the lubrication product can become difficult, such as difficulty in filling the joint with the lubricant. If the worked penetration is more than 340 0.1 mm at 25° C., the composition can become too soft and there is a possibility that the lubricant will flow out of the gliding surface of the joint, resulting in poor lubrication with the increased torque or abnormal abrasion in the joint.

The dripping point is preferably 80° C. or more, especially 95° C. or more, preferably 100° C. or more in the lubricant product of this invention for ball joints. In actual use in a motor car, there is a possibility that the temperature will reach 80° C. in the joint close to the engine due to heat radiation and, with the lubricant product with the dripping point of about 80° C., there is a possibility that the lubricant product will flow from the gliding surface of ball joint, resulting in the abnormal abrasion and the damaged joint.

The invention is explained in more detail with application examples and comparative examples. However, the invention is not limited by these examples.

EXAMPLE

Example 1

According to the Invention

A stainless steel container was charged with 200 g of polyisoprene (viscosity agent A, hereafter) with a viscosity of $5.2\times10^4$ mN.s/m$^2$ (cP) at 25° C., 80 g of ethylene bis-stearylamide (amide A, hereafter) and 30 g of polyethylene wax, and the content was heated to the temperature of 150° C. with stirring. Heating was stopped when the content was melted and became transparent, and amine type antioxidant was added at 1.0% followed by cooling to the normal temperature. The content was kneaded to uniformity with a three-roll mill to obtain the lubricant product. The worked penetration was 283 0.1 mm at 25° C., and the dripping point was 130° C. in the lubricant product thus obtained.

Example 2

According to the Invention

Viscosity agent (viscosity agent B, hereafter) was obtained by mixing polyisoprene with the viscosity of $5.2\times10^6$ mN.s/m2 (cP) at 25° C. at 60 wt % and poly-α-olefin as the synthetic oil with the kinematic viscosity of 33.0 $mm^2$/sec at 40° C. at 40 wt %. The viscosity of the viscosity agent B was $8.0\times10^4$ mN.s/$m^2$ (cP) at 25° C. as measured with type B viscosimeter. A stainless steel container was charged with 200 g of this viscosity agent, 70 g of amide A and 30 g of paraffin wax and the content was heated to 150° C. while the content was stirred. When the content was melted and became transparent, heating was stopped, and an amine type antioxidant was added at 1.0%, followed by cooling of the content to the normal temperature. The content was made homogeneous with three-roll mill to obtain a lubricant product. The worked penetration was 268 0.1 mm at 25° C., and the dripping point was 124° C. for the product thus obtained.

Example 3

According to the Invention

Polyisoprene with a viscosity of $5.2\times10^6$ mN.s/$m^2$ (cP) at 25° C. at 40 wt % and 60 wt % mineral oil with a kinematic viscosity of 23.5 $mm^2$/sec at 40° C. were mixed to obtain a viscosity agent (viscosity agent C, hereafter). The viscosity of this agent was $1.1\times10^4$ mN.s/$m^2$ (cP) at 250° C. as measured by type B viscosimeter. A stainless steel container was charged with 200 g of the viscosity agent C, 60 g of amide A and 40 g of microcrystalline wax. The content was heated to the temperature of 150° C. with stirring. When the content was melted and became transparent, heating stopped and after addition of amine type antioxidant at 1.0%, the content was cooled to the normal temperature. The content was homogenized, after cooling, with a three-roll mill to obtain a lubricant product. The worked penetration was 295 0.1 mm at 250° C. and the dripping point was 129° C. for the product thus obtained.

Example 4

According to the Invention

A stainless steel container was charged with 200 g of viscosity agent B, 80 g of stearylamide (amide B, hereafter) and 30 g of microcrystalline wax. The content was heated to 150° C. with stirring, and when the content was melted and became transparent, heating was stopped. Amine type antioxidant was added at 1.0% followed by cooling to the room temperature. After cooling, the content was made homogeneous with a three-roll mill to obtain a lubricant product. The worked penetration was 310 0.1 mm at 25° C., and the dripping point was 95° C.

Example 5

According to the Invention

A stainless steel container was charged with 200 g of viscosity agent B and 40 g each of amide A and oleylamide (amide C, hereafter), follow by addition of 30 g of microcrystalline wax. The content was heated to the temperature of 150° C. with stirring, and heating was stopped when the content was melted and became transparent. Amine type antioxidant was added at 1.0% followed by cooling to the room temperature. The content was homogenized with a three-roll mill to obtain a lubricant product. The worked penetration was 292 0.1 mm at 25° C., and the dripping point was 102° C. for the product.

Comparative Example 1

A stainless steel container was charged with 200 g of viscosity agent B followed by addition of 50 g each of amide A and oleylamide C. The content was heated to the temperature of 150° C. with stirring. The process and method were the same as those used in Examples 1–5 according to the invention. The worked penetration was 294 0.1 mm at 25° C., and the dripping point was 107° C. for the lubricant product thus obtained.

Comparative Example 2

We obtained a viscosity agent (viscosity agent D, hereafter) by mixing polyisoprene with viscosity of $3.0\times10^6$ mN.s/$m^2$ (cP) at 25° C. at 80 wt % and poly-α-olefin with a kinematic viscosity of 33.0 $mm^2$/sec at 40° C. at 20 wt %. The viscosity of the viscosity agent D was $5.0\times10^5$ mN,s/m2 (cP) at 25° C. (outside the range of viscosity set in this invention) as measured by type B viscosimeter. A stainless steel container was charged with 200 g of this viscosity agent, 70 g of amide A and 20 g of paraffin wax, and the content was heated to the temperature of 150° C. with stirring. The following process and method were the same as in Examples 1–5 according to the invention. The worked penetration was 255 0.1 mm at 25° C. and the dripping point was 130° C. for the lubricant product thus obtained.

Comparative Example 3

Viscosity agent (viscosity agent E, hereafter) was prepared by mixing polyisoprene with a viscosity of $1.5\times10^5$ mN.s/m (cP) at 250° C. at 30 wt % and mineral oil with the kinematic viscosity of 26.0 $mm^2$/sec at 40° C. at 70 wt %. The viscosity measured by type B viscosimeter was 800 mN.s/$m^2$ (cP) (outside the range defined in this invention) at 25° C. A stainless steel container was charged with 200 g of viscosity agent E, 70 g of amide A and 30 g of microcrystalline wax and the content was heated to the temperature of 150° C. with stirring. The processes and methods which followed were the same as in Examples 1–5 according to the invention. The worked penetration was 294 0.1 mm at 250° C., and the dripping point was 125° C. for the product thus obtained.

Comparative Example 4

We used lithium type grease for ball joints on the market produced by us.

Comparative Example 5

We used lithium type grease for general use on the market from another producer.

Comparative Example 6

We used amide type grease for ball joints on the market from another producer.

Evaluation

Table I and Table II show general properties and results of the torque test and endurance test for lubricant products obtained in Examples 1–5 according to the invention and lubricant and grease obtained in Comparative Examples 1–6. The test methods are described below. Torque test and endurance test were performed on the various types of lubricant products using ball joint test machine shown in FIGS. 1 to 4.

Explanation of the symbols

Figure 1A:
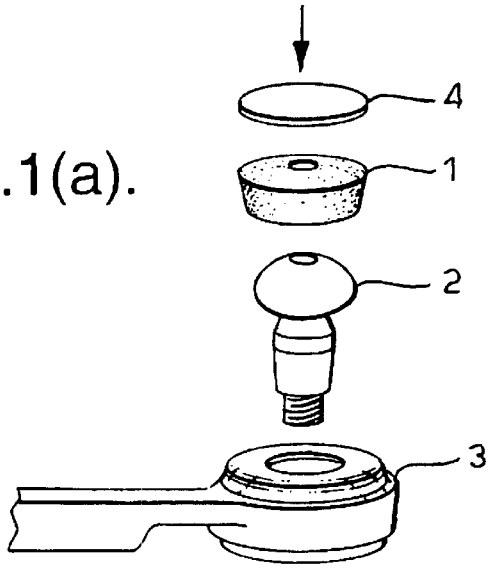
FIG. 1 is a general structure for a plastic ball joint, (a) shows the parts and general method of construction and (b) shows the general structure of the finished machinery.
Figure 1B:
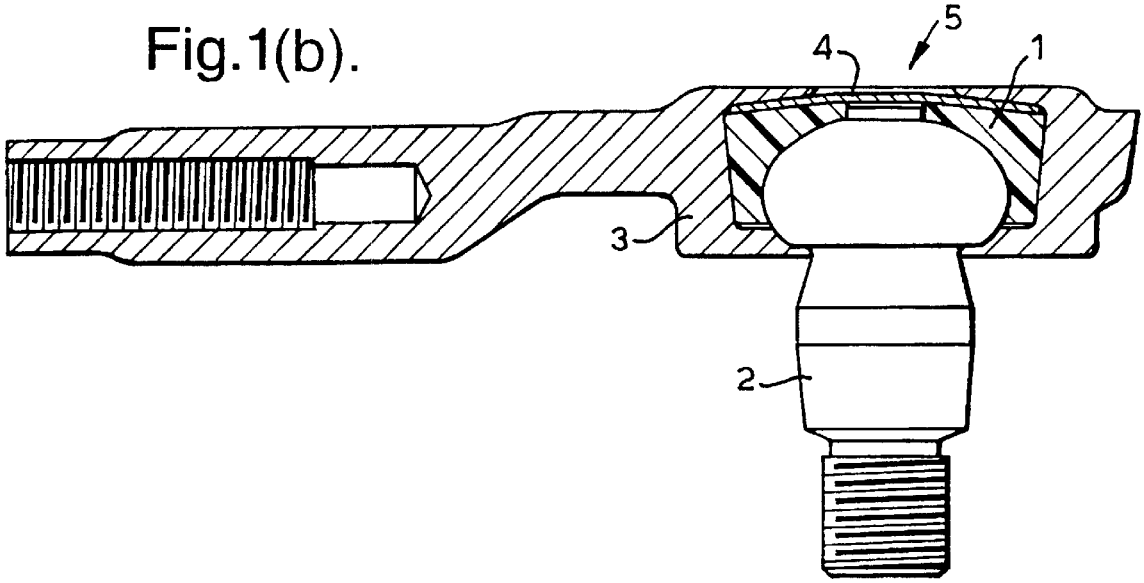
Figure 2:
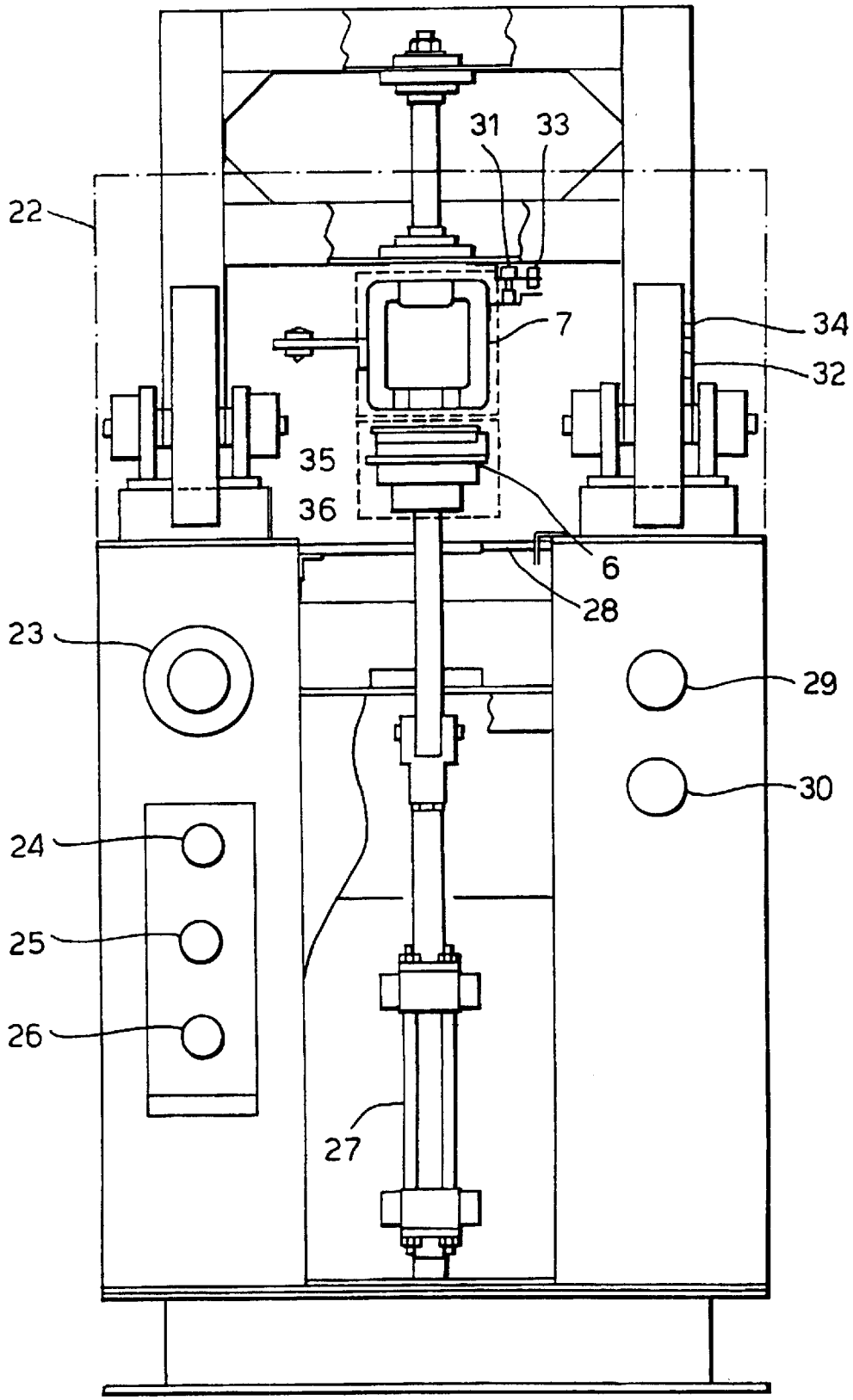
FIG. 2 is a general structure of the testing machinery to evaluate the torque characteristics of grease at a ball joint.
Figure 3:
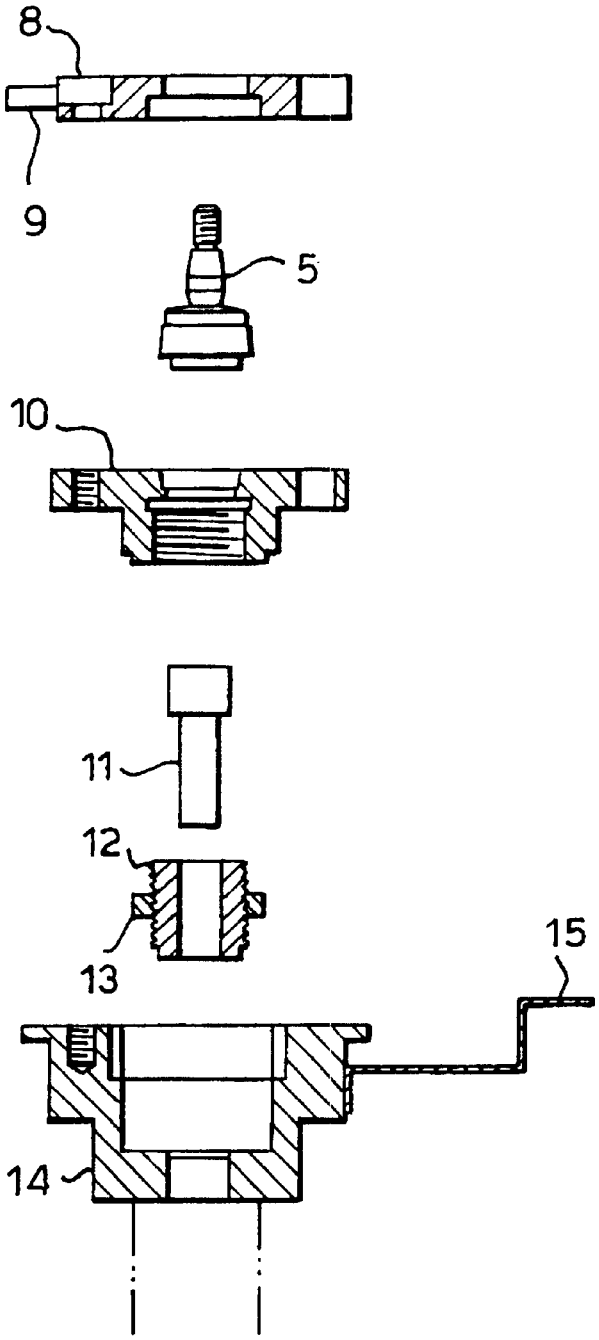
FIG. 3 shows detached parts at the loading position of FIG. 2.
Figure 4:
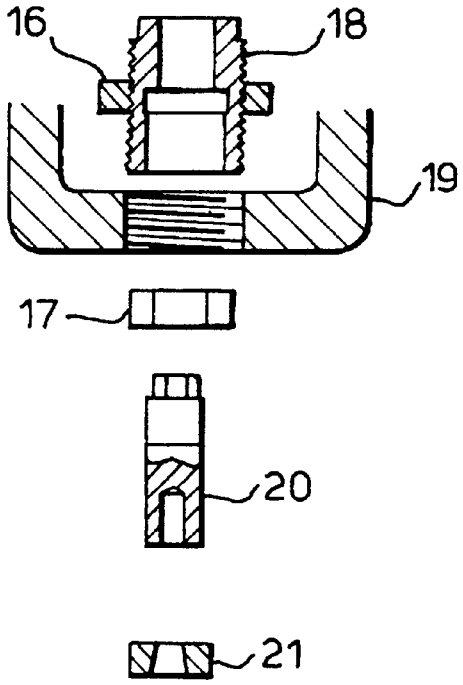
FIG. 4 show parts broken up at the rotating position of FIG. 2.

1. Ball seat
2. Ball stat
3. Socket
4. Steel plate
5. Ball joint
6. Loading Part
7. Rotating part
8. Cover for winding part
9. Place for attachment of thermocouple
10. Receptacle
11. Plug for prepressure
12. Prepressure fixing nut
13. Fixing nut
14. Location of attachment
15. Indicator needle
16. Nut for stopping slippage
17. Nut for stopping slippage
18. Adjustment nut
19. Frame for rotation
20. Binding nut
21. Adapter
22. Safety valve
23. Load cylinder DP cell
24. Load cylinder relief valve
25. Vibration cylinder relief valve
26. Rotation cylinder relief valve
27. Load cylinder
28. Indicator needle
29. Vibration cylinder oil pressure gauge
30. Rotation cylinder oil pressure gauge
31. Limit switch
32. Limit switch
33. Limit switch ball joint
34. Near switch
35. Near switch
36. Near switch 1) Method of Torque Test Ball stat: chromium molybdenum steel, diameter of spherical head: 20 mm Ball stat: polyamide resin Test conditions Temperature: 25° C. and 20° C.

Pre-pressure: 1,000 kg

Rotation: ±30° C.; 30 cycles per minute

Starting torque: Maximum torque at the start of movement after 2 hours of resting period following construction of the joint (kg·cm).

Rotatory torque: After the measurement of the aforementioned starting torque, the ball stat was rotated 10 times followed by measurement of this rotatory torque (kg·cm)

The ball joint was constructed after uniformly coating the lubricant to be tested over the surface of the ball stat and ball seat. As the starting torque, we measured the maximum torque at the first 2 hours after the construction of the joint. After the measurement of the starting torque as described above, we measured the rotatory torque immediately after the rotation of the ball stat 10 times.

2) Method of Endurance Test on Ball Joints

Endurance test was performed under the conditions described below on the ball joint constructed in 1) described above. The evaluation was made by the amount of lift of the ball stat. The amount of lift is defined as the amount of movement (deformation) of the ball stat described above when a load of 50 kg was placed on the ball stat in the axial direction.

Test conditions

Temperature: 25° C.

Pre-pressure: 1,000 kg

Load: ±250 kg, 60 cycles per minute (axial direction)

Oscillation: ±15° C., 50 cycles per minute,

Rotation: ±15° C., 50 cycles per minute

Oscillation: $10^6$ times

Lift measurement: multiplied by ±50 kg

As (C) component in Example according to the invention and Comparative Example, we used waxes commercially available, and their physical properties are listed below.

Polyethylene wax—average molecular weight of 1,000, penetration value 25, melting point of 109° C.

Paraffin wax—average molecular weight of 640, penetration value 13, melting point of 65° C.

Microcrystalline wax—average molecular weight of 620, penetration value 21, melting point of 70° C.

With lubricant products of Examples 1–5 according to the invention, the torque of the ball joint is small at room temperature (25° C.) as well as at low temperature (−20° C.). The difference is small between starting torque and the rotation torque. Especially, the torque at the normal temperature is small. Excellent results were obtained in that small amounts of lift were found in the endurance test. With the product of Comparative Example 1 prepared without addition of component (C), the rotatory torque is greater at both the normal and low temperature in comparison with Example 5 according to the invention. Further, the starting torque is greater at normal temperature. With the product of Comparative Example 2 in which the component (A) was a viscosity agent with high viscosity of $10^5$ mN.s/$m^2$ (cP) or more, high starting and rotatory torques were observed at the normal and high temperature. With the product of Comparative Example 3 in which component (A) was a viscosity agent with a viscosity lower than $3\times10^3$ mN.s/$m^2$, a high rotatory torque was shown at low temperature, and both the starting and rotatory torque were high at the normal temperature. In Comparative Examples 4–6, we used popular commercial grease products. The value of both the starting and rotatory torque at the normal temperature were high in Comparative Example 4 and those at low temperature were high in Comparative Example 6. In Comparative Example 5, the torque values were high at the normal and low temperatures.

TABLE I

| Compositions and properties (parts by weight, g) | | | | Example according to the invention | | | | |
|---|---|---|---|---|---|---|---|---|
| | | | | 1 | 2 | 3 | 4 | 5 |
| Component (A) | Viscosity agent A | | | 200 | | | | |
| | Viscosity agent B | | | | 200 | | 200 | 200 |
| | Viscosity agent C | | | | | 200 | | |
| | Viscosity agent D | | | | | | | |
| | Viscosity agent E | | | | | | | |
| Component (B) | Amide A | | | 70 | 70 | 60 | | 40 |
| | Amide B | | | | | | 80 | |
| | Amide C | | | | | | | 40 |
| Component (C) | Polyethylene wax | | | 30 | | | | |
| | Paraffin wax | | | | 30 | | | |
| | Microcrystalline wax | | | | | 40 | 30 | 30 |
| General Properties | Worked penetration | | | 283 | 268 | 295 | 310 | 292 |
| | Dripping point ° C. | | | 130 | 124 | 129 | 95 | 102 |
| | Volume of evaporation (99° C., 22 Hr) | | | 0.56 | 0.61 | 0.55 | 0.53 | 0.58 |
| | Stability against oxidation % wt (99° C., 100 Hr) (Mpa) | | | 0.022 | 0.024 | 0.025 | 0.025 | 0.024 |
| Ball joint Test | Torque test kg.cm | −20° C. | Starting torque | 40.4 | 45.8 | 47.3 | 41.4 | 45.0 |
| | | | Rotation torque | 23.0 | 23.6 | 23.9 | 25.9 | 24.8 |
| | | 25° C. | Starting torque | 22.0 | 19.0 | 24.0 | 28.5 | 25.3 |
| | | | Rotation torque | 11.8 | 11.5 | 11.0 | 12.3 | 12.0 |
| | Amount of lift in endurance test ($10^6$ times) mm | | | 0.047 | 0.039 | 0.043 | 0.047 | 0.050 |

TABLE II

| Compositions and properties (parts by weight, g) | | | | Comparative Example | | | | | |
|---|---|---|---|---|---|---|---|---|---|
| | | | | 1 | 2 | 3 | 4 | 5 | 6 |
| Component (A) | Viscosity agent A | | | | | | | | |
| | Viscosity agent B | | | 200 | | | | | |
| | Viscosity agent C | | | | | | | | |
| | Viscosity agent D | | | | 200 | | | | |
| | Viscosity agent E | | | | | 200 | | | |
| Component (B) | Amide A | | | 50 | 70 | 70 | | | |
| | Amide B | | | | | | | | |
| | Amide C | | | 50 | | | | | |
| Component (C) | Polyethylene wax | | | | | | | | |
| | Paraffin wax | | | | 20 | | | | |
| | Microcrystalline wax | | | | | 30 | | | |
| General Properties | Worked penetration | | | 294 | 255 | 294 | 278 | 276 | 244 |
| | Dripping point ° C. | | | 107 | 130 | 125 | 200 | 193 | 62 |
| | Volume of evaporation (99° C., 22 Hr) | | | 0.72 | 0.55 | 0.58 | 0.35 | 0.45 | 0.40 |
| | Stability against oxidation % wt (99° C., 100 Hr) (Mpa) | | | 0.028 | 0.024 | 0.026 | 0.034 | 0.017 | 0.429 |
| Ball joint Test | Torque test kg.cm | −20° C. | Starting torque | 43.3 | 64.3 | 45.5 | 41.3 | 65.7 | 68.4 |
| | | | Rotation torque | 28.4 | 40.2 | 28.3 | 28.4 | 58.4 | 35.3 |
| | | 25° C. | Starting torque | 28.3 | 30.8 | 25.5 | 35.6 | 37.3 | 33.6 |
| | | | Rotation torque | 13.1 | 19.1 | 16.2 | 20.5 | 35.8 | 11.9 |
| | Amount of lift in endurance test ($10^6$ times) mm | | | 0.051 | 0.030 | 0.054 | 0.045 | 0.300 | 0.039 |

What is claimed is:

1. A lubricant composition comprising:

(A) about 100 parts by weight of at least one viscous material having a viscosity from about $3\times10^3$ to about $3\times10^5$ mN s/m$^2$ (cP) at 25° C. selected from the group consisting of:

(i) polyisoprene rubber; and, (ii) a viscous composition comprising polyisoprene rubber;

(B) about 14 to about 45 parts by weight of at least one compound selected from the group consisting of aliphatic amides represented by Formula (1)

$$R^1CONH_2 \quad (1)$$

wherein $R^1$ represents a saturated or unsaturated alkyl group containing 15 to 17 carbon atoms, and aliphatic bisamides represented by Formula (2)

$$R^1CONHR^2NHCOR^1 \quad (2)$$

wherein $R^1$ represents a saturated or unsaturated alkyl group and $R^2$ represents methylene or ethylene; and, (C) about 5 to about 30 parts by weight of at least one wax selected from the group consisting of polyethylene wax, paraffin wax and microcrystalline wax.

2. The composition of claim 1 in which the viscous composition comprising polyisoprene rubber further comprises mineral oil.

3. The composition of claim 2 in which the viscous composition comprising polyisoprene rubber further comprises synthetic oil.

4. The composition of claim 1 further comprising an anti-oxidant, a rust-proofing agent, an antiabrasion agent and an extreme pressure agent.

5. The composition of claim 1 in which the lubricant composition has a dripping point equal to or greater than about,80° C.

6. The composition of claim 5 in which the dripping point is equal to or greater than about 100° C.

7. The composition of claim 1 in which the wax is a polyethylene wax having an average molecular weight of from 900 to 4000 and a melting point of from about 100° C. to about 130° C.

8. The composition of claim 1 in which the wax is a paraffin wax having an average molecular weight of from 300 to 500 and a melting point of from about 40° C. to about 70° C.

9. The composition of claim 1 in which the wax is a microcystalline, wax having an average molecular weight of from 500 to 700 and a melting point of from about 60° C. to about 100° C.

10. A ball joint comprising:

a ball seat of synthetic resin;

a metal ball stat that is seated in the ball seat; and, a lubricant composition in the ball joint comprising:

a. about 100 parts by weight of at least one viscous material having a viscosity from about $3\times10^3$ to about $3\times10^5$ mN·s/m$^2$ (cP) at 25° C. selected from the group consisting of:

i. polyisoprene rubber; and, ii. a viscous composition comprising polyisoprene rubber;

b. about 14 to about 45 parts by weight of at least one compound selected from the group consisting of aliphatic amides represented by Formula (1)

$$R^1CONH_2 \quad (1)$$

wherein $R^1$ represents a saturated or unsaturated alkyl group containing 15 to 17 carbon atoms, and aliphatic bisamides represented by Formula (2)

$$R^1CONHR^2NHCOR^1 \quad (2)$$

wherein $R^1$ represents a saturated or unsaturated alkyl group and $R^2$ represents methylene or ethylene; and, about 5 to about 30 parts by weight of at least one wax selected from the group consisting of polyethylene wax, paraffin wax and microcrystalline wax.

11. The ball joint of claim 7 in which lift after endurance is equal to or less than about 0.1 mm.

12. The ball joint of claim 7 in which the ball joint has a starting torque at −20° C. of about 50.0 kg·cm or less.

13. The ball joint of claim 7 in which the ball joint has a rotating torque at −30° C. of about 30 kg·cm or less.

14. The ball joint of claim 7 in which the ball joint has a starting torque at 25° C. of 30.0 kg·cm or less.

15. The ball joint of claim 7 in which the ball joint has a rotating torque at 25° C. of 13.0 kg·cm or less.

* * * * *